US006659669B1

(12) United States Patent
Nguyen

(10) Patent No.: US 6,659,669 B1
(45) Date of Patent: Dec. 9, 2003

(54) MESH NETTING TO HOLD SOAP

(76) Inventor: Truong H. Nguyen, 322 S. Burkett Dr., Apartment 2A, Panama City, FL (US) 32404

( * ) Notice: Subject to any disclaimer, the term of this patent is extended or adjusted under 35 U.S.C. 154(b) by 0 days.

(21) Appl. No.: 10/108,373

(22) Filed: Mar. 29, 2002

(51) Int. Cl.[7] ..... A47K 7/04

(52) U.S. Cl. ..... 401/8; 15/229.11; 15/229.13; 206/77.1; 401/201; D6/608

(58) Field of Search ..... 401/8, 201; 15/229.11, 15/229.13; 206/77.1; D6/608

(56) References Cited

U.S. PATENT DOCUMENTS 1,351,311 A * 8/1920 Virneburg ..... 401/8
2,771,224 A * 11/1956 Boerger ..... 401/8 X
3,099,032 A * 7/1963 Webb ..... 401/8
4,228,834 A 10/1980 Desnick
4,501,354 A * 2/1985 Hoffman ..... 206/77.1
4,789,125 A 12/1988 Sanchez
5,366,125 A 11/1994 Procido
5,722,575 A * 3/1998 Smith ..... 401/8 X

* cited by examiner

*Primary Examiner*—David J. Walczak
*Assistant Examiner*—Kathleen J. Prunner
(74) *Attorney, Agent, or Firm*—Richard C. Litman

(57) ABSTRACT

A tubular mesh netting soap holder and dispenser having a handle having a wide slot and a narrow slot at opposing ends. The wide slot holds the netting closed end. A VELCRO® loop material closure strap having loop material on its inner side is attached to the tubular mesh at a soap bar receiving open end. The loop closure strap threads through the narrow slot at the other end of the handle. There is a VELCRO® hook material patch mounted on the handle top near the narrow slot, which mates with the loop closure strap on its inner side, once threaded through the smaller slot and pulled snug. As the soap bar is used, the loop closure strap is detached, pulled through the smaller slot until snug again, and remounted on the hook material patch. A suction cup is on the handle for wall hanging.

9 Claims, 6 Drawing Sheets

MESH NETTING TO HOLD SOAP

BACKGROUND OF THE INVENTION

1. Field of the Invention

The present invention relates to cleansing apparatus. More particularly, the present invention relates to soap bar holding devices for use when bathing.

2. Description of the Related Art

There have been many attempts to provide a convenient and inexpensive holder for a soap bar for use in a bath or shower. A common problem with soap bars is that they tend to slip out of the users hand when wet. Such well known devices such as a soap bar molded around a portion of a suspending cord or rope have been widely used. A problem which has not been adequately addressed is the usefulness of the device as the soap bar dissipates. Only limited choices of soap are available specially molded onto or around the device. It would be desirable to provide a holder for standard soap bars which prevents slippage from the hand when wet, aids in the distribution on the skin while aiding in lathering and scrubbing the skin, and which is adjustable as a soap bar dissipated in use. It would further be desirable to provide a holder which may be easily dried, along with the soap bar by hanging in ambient air and preferably has a hanging feature which allows attachment to a nearby bath wall. It would also be desirable to provide such a holder which allows the soap bar to be held in the palm of the hand during use.

U.S. Pat. No. 4,789,262, issued Dec. 6, 1988, to Sanchez, describes a soap holding cleaning pad apparatus including a mesh forming portion, a handle, and an opening sealed with a hook and loop material.

U.S. Pat. No. 4,228,834, issued Oct. 21, 1980 to Desnick, describes a soap bag formed of a plastic mesh with VELCRO fasteners for closing the bag. A loop segment is provided for attachment of a strap.

U.S. Pat. No. 5,366,125, issued Nov. 22, 1994, to Procido, describes a mesh soap container with an elastic loop for hanging on the user's neck and having an opening in the top surface. The opening is bordered by elastic for the insertion and removal of the soap bar.

None of the above inventions and patents, taken either singularly or in combination, is seen to describe the instant invention as claimed. Thus, a mesh netting to hold soap solving the aforementioned problems is desired.

SUMMARY OF THE INVENTION

A tubular mesh netting soap holder and dispenser has a handle reaching around the user's hand. The mesh netting is of fabric or similar material and is held in a wide slot at one end of the handle and encases the soap bar inserted through an opposite end opening. A VELCRO® loop material closure strap having loop material on its inner side is attached to the tubular mesh at its end opening. The loop material closure strap threads through a smaller slot at the other end portion of the handle. There may be more than one concentric tube of mesh netting employed.

There is a VELCRO® hook material patch mounted on the top of the handle near the narrow slot which mates with Velcro® loop, material closure strap on its inner side, once threaded through the smaller slot and pulled snug. As the soap bar becomes smaller during use, the VELCRO® loop material closure strap is detached, pulled through the smaller slot until snug again, and mounted at an inward position on the handle VELCRO® hook material to maintain the mesh tight around the soap bar. The handle is generally "T" shaped with the wide slot holding end portion being the cross portion of the "T" and the narrow slot being at the tail thereof. The hook material patch mounted along the strip portion on the top of the handle and the mating loop material on the inside of the closure strap form a means for adjustably and removably mounting the closure strap to the top side of the handle.

In another embodiment, the handle has a suction cup mounted near the cross portion of the handle and projecting outward from the top of the handle to serve as a means for mounting the soap holder on a bath wall when not in use. The soap and holder dry, easily in ambient air when the holder is so mounted. In use, the user's hand is placed between the handle and the mesh holding the soap so that the hand grasps the mesh encased soap. The soap is then wetted and distributed through the netting on the users skin, for washing. The mesh netting assists in lathering and scrubbing the skin during soap application to the skin.

Accordingly, it is a principal object of the invention to provide a tubular mesh netting soap bar holder, allowing a nonslip grasp of the soap bar in the palm of the user's hand.

It is another object of the invention to provide a soap bar holder as above having a handle supporting the mesh net, the handler being arranged to be placed over the back of the user's hand, providing for positive attachment of the holder to the hand.

It is a further object of the invention to provide for adjustment of the size of the tubular mesh netting of the soap bar holder as above so as to allow for a positive grasp of a soap bar as it dissipates and reduces in size during repeated use.

Still another object of the invention is to provide a soap bar holder as above having a suction device mounted on the handle of the holder for mounting on a bath wall for easy drying of the soap bar and holder in ambient air when not in use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

A tubular mesh netting soap holder and dispenser has a handled reaching around the user's hand. The mesh netting is of fabric or similar material and is held in a wide slot at one end of the handle and encases the soap bar inserted through an opposite end opening. A VELCRO® loop material closure strap having loop material on its inner side is attached to the tubular mesh at its end opening. The loop material closure strap threads through a smaller slot at the other end portion of the handle. There may be more than one concentric tube of mesh netting employed.

There is a VELCRO® hook material patch mounted on the top of the handle near the narrow slot which mates with Velcro® loop material closure strap on its inner side, once threaded through the smaller slot and pulled snug. As the soap bar becomes smaller during use, the VELCRO® loop material closure strap is detached, pulled through the smaller slot until snug again, and mounted at an inward position on the handle VELCRO® hook material to maintain the mesh tight around the soap bar. The handle is generally "T" shaped with the wide slot holding end portion being the cross portion of the "T" and the narrow slot being at the tail thereof.

In another embodiment, the handle has a suction cup mounted near the cross portion of the handle and projecting outward from the top of the handle to serve as a means for mounting the soap holder on a bath wall when not in use. The soap and holder dry easily in ambient air when the holder is so mounted. In use, the user's hand is placed between the handle and the mesh holding the soap so that the hand grasps the mesh encased soap. The soap is then wetted and distributed through the netting on the users skin for washing. The mesh netting assists in lathering and scrubbing the skin during soap application to the skin.

Figure 1:
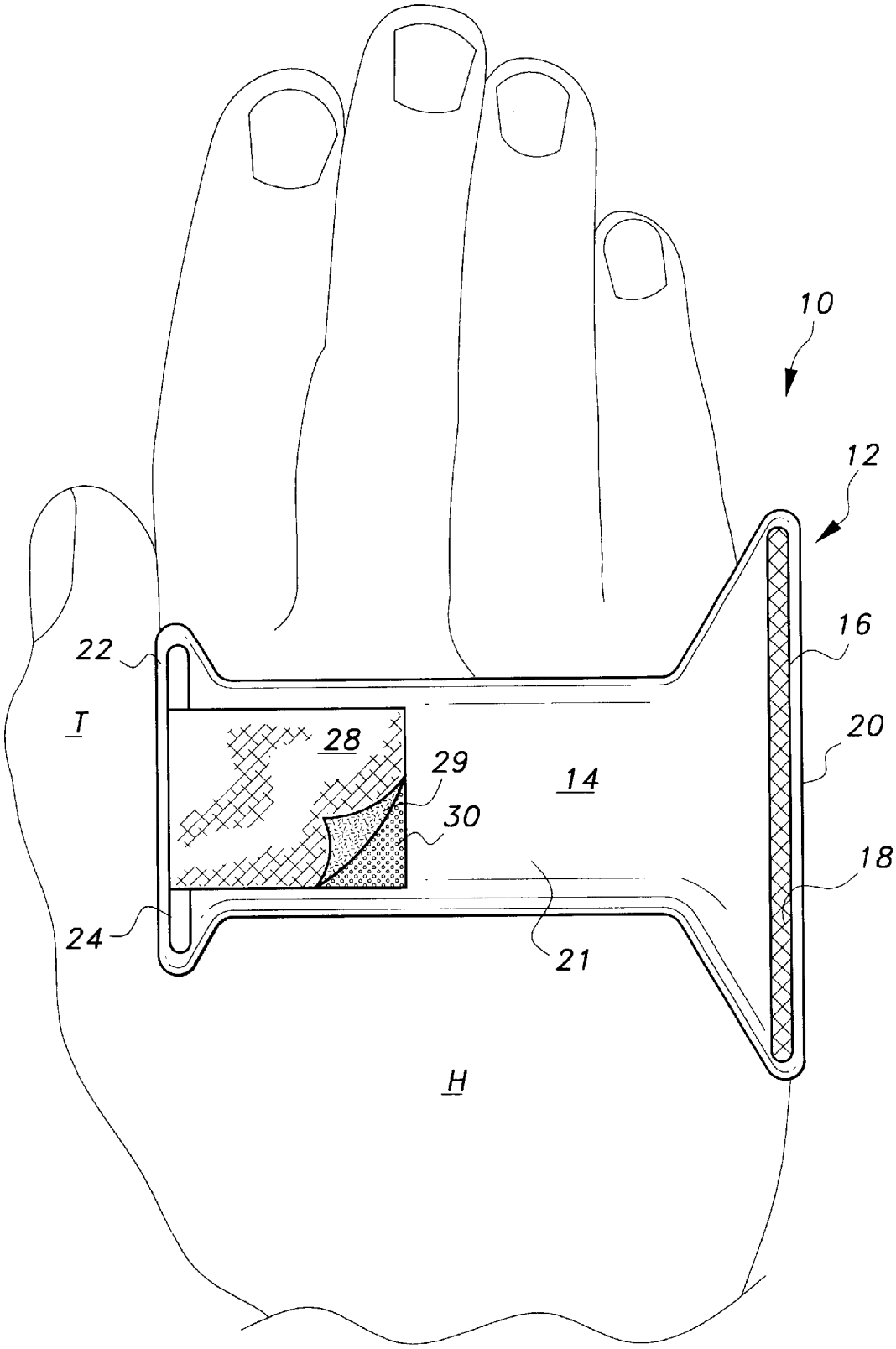
FIG. 1 is a environmental top view of a tubular mesh netting soap bar holder according to the present invention as held in the user's hand.
Figure 2:
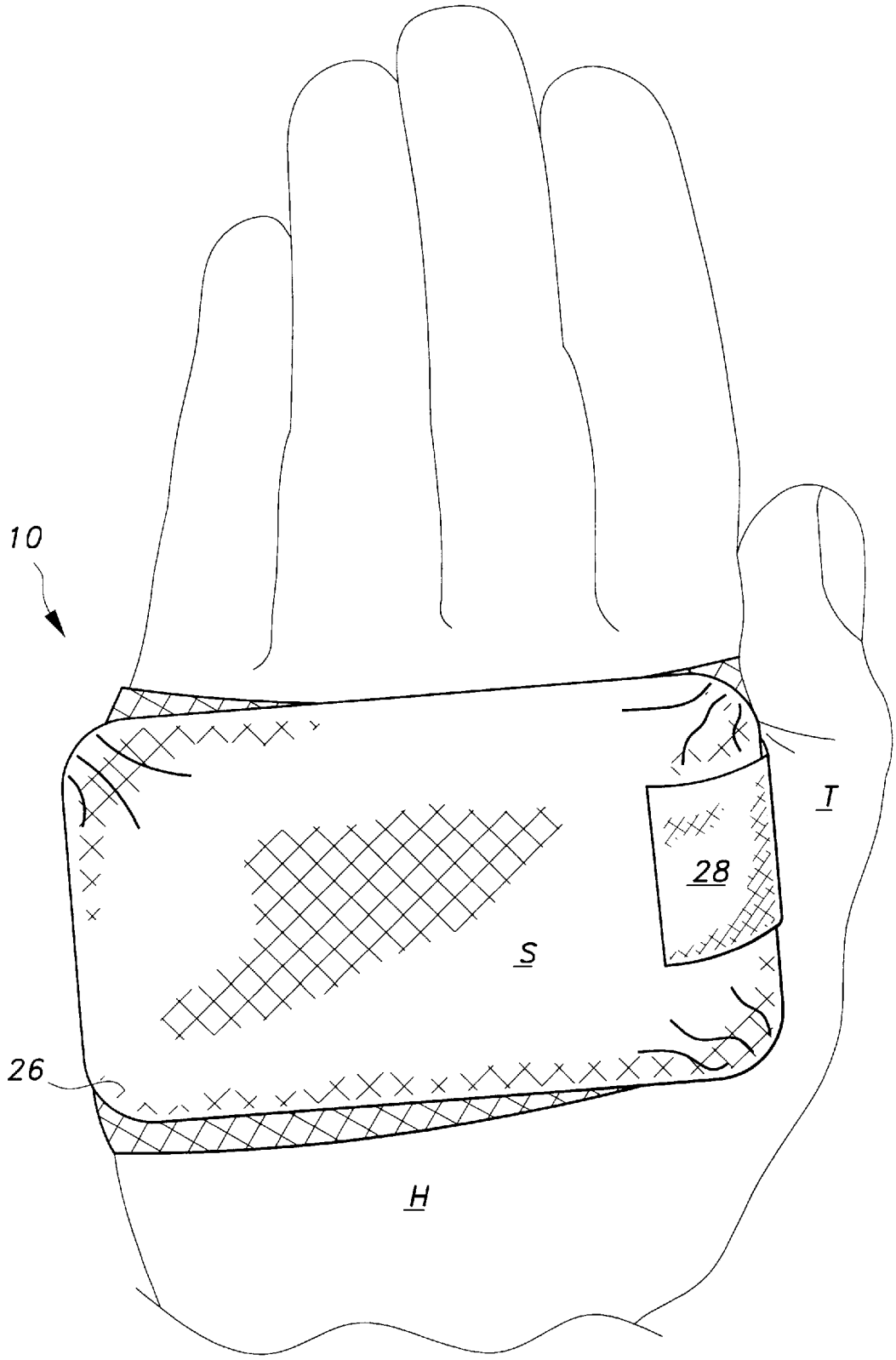
FIG. 2 is an environmental bottom view of the soap holder of FIG. 1 as the user's hand is inserted between the mesh netting and a handle attached thereto with fingers outstretched.

Referring to FIGS. 1 and 2, there are shown top and bottom views, respectively, of the mesh netting soap holder 10 of the present invention as worn on hand H and holding soap bar S. Soap holder 10 comprises a generally planar, elongate, flexible, "T" shaped handle 12 having a top side 14 and a bottom side 15 and having a wide slot 16 for holding bunched mesh netting end 18 and defined by wide end portion 20 (the cross bar end of the "T"). Handle 12 extends along a strip portion 21 to narrow end portion 22(the tail end of the "T"). Narrow end portion 22 defines narrow slot 24.

Tubular mesh netting 26 forms a soap bar holding portion and has a closed end portion and an open end portion, the mesh netting 26 closed end portion being fixed at wide slot 16. Tubular mesh netting 26 then extends to netting opening 27(see FIGS. 3 and 4) to which is attached loop material closure strap 28 extending axially therefrom. Soap bar S may be inserted through netting opening 27. The netting 26 and soap bar S are held on the palm side of hand H. Loop material closure strap 28 extends between the thumb T and first finger around to narrow end portion 22 of handle 12 where it is threaded through narrow slot 24 of handle narrow end portion 22. Closure strap 28, having loop material 29 on its inner side, is pulled snug and removably mounted on hook material patch 30 located on handle top side 14 extending along strip portion 21 of handle 12.

Figure 3:
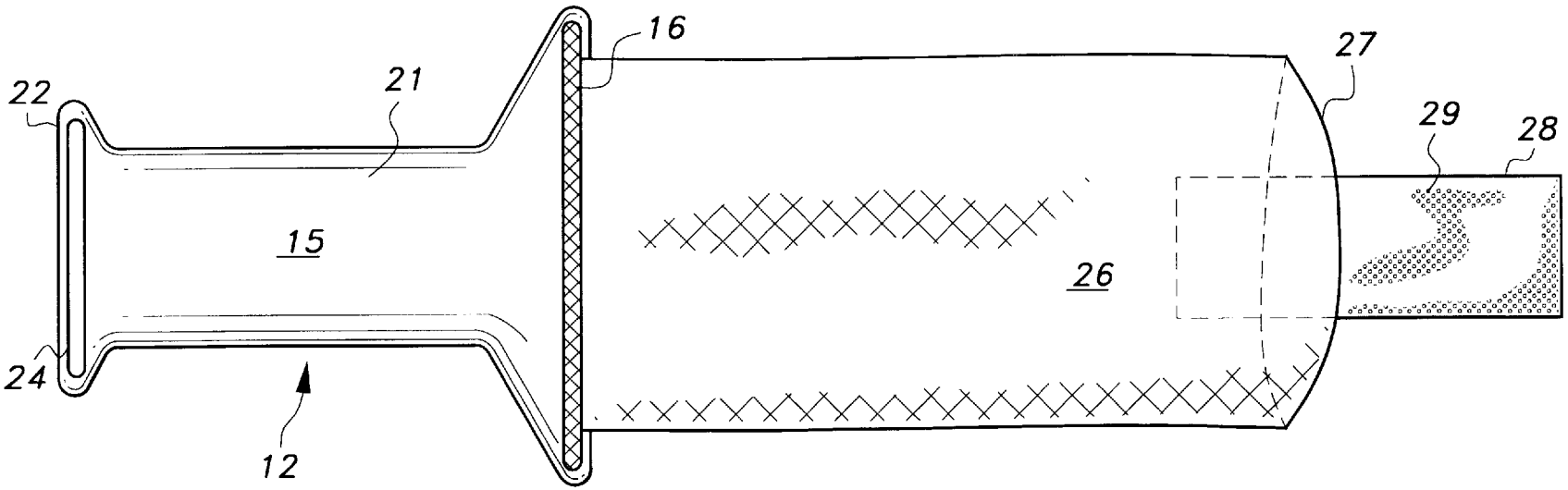
FIG. 3 is a bottom view of the soap holder of FIG. 1 in an opened position.
Figure 4:
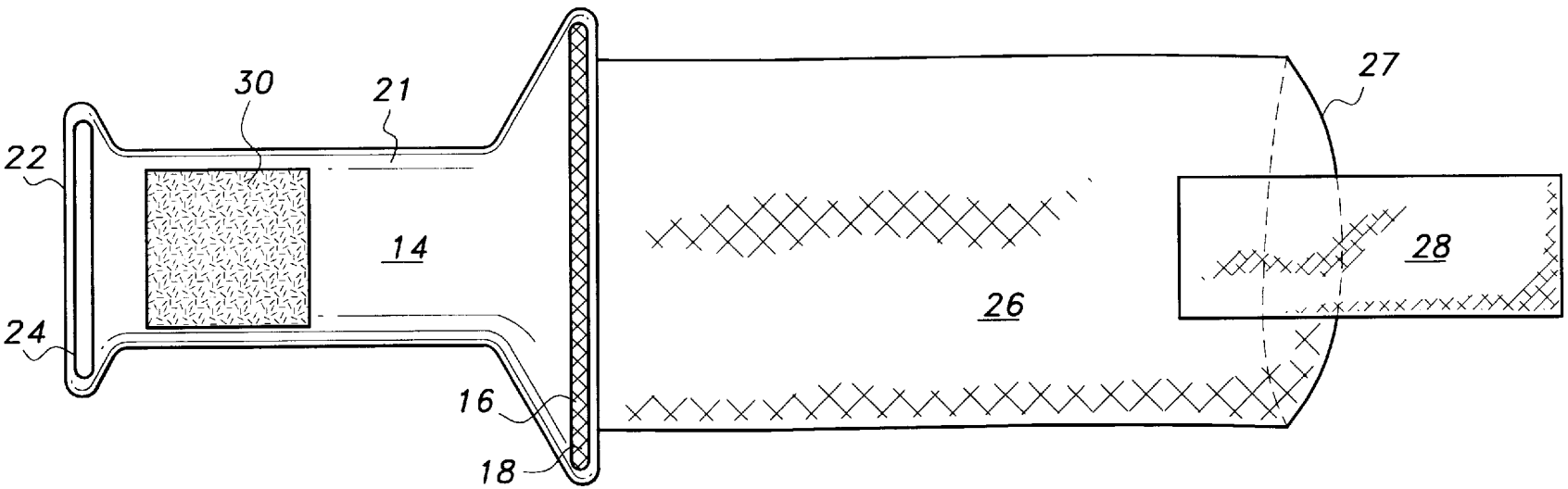
FIG. 4 is a top view of the soap holder of FIG. 1 in an opened position.

Referring to FIGS. 3 and 4, there are shown a bottom view and a top view, respectively, of the soap holder 10 in an open state showing the tubular netting open end 27 and the loop material closure strap 28 released from narrow slot 24 and the netting 26 extending outward from wide slot 16 in wide end portion 20 of handle 12. A rectangular hook material patch 30 mounted along strip portion 21 on the top side 14 extending toward narrow slot 24 of handle 12 for mating with loop material 29 on the inside of closure strap 28.

Figure 5A:
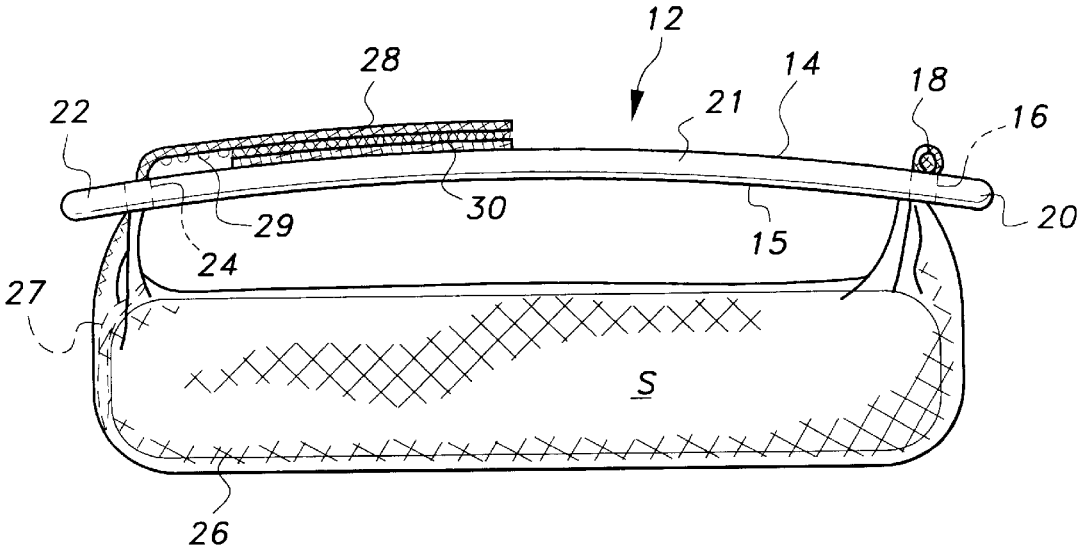
FIG. 5A is a side view of the soap holder of FIG. 1 in a closed state as arranged to hold a bar of soap.
Figure 5B:
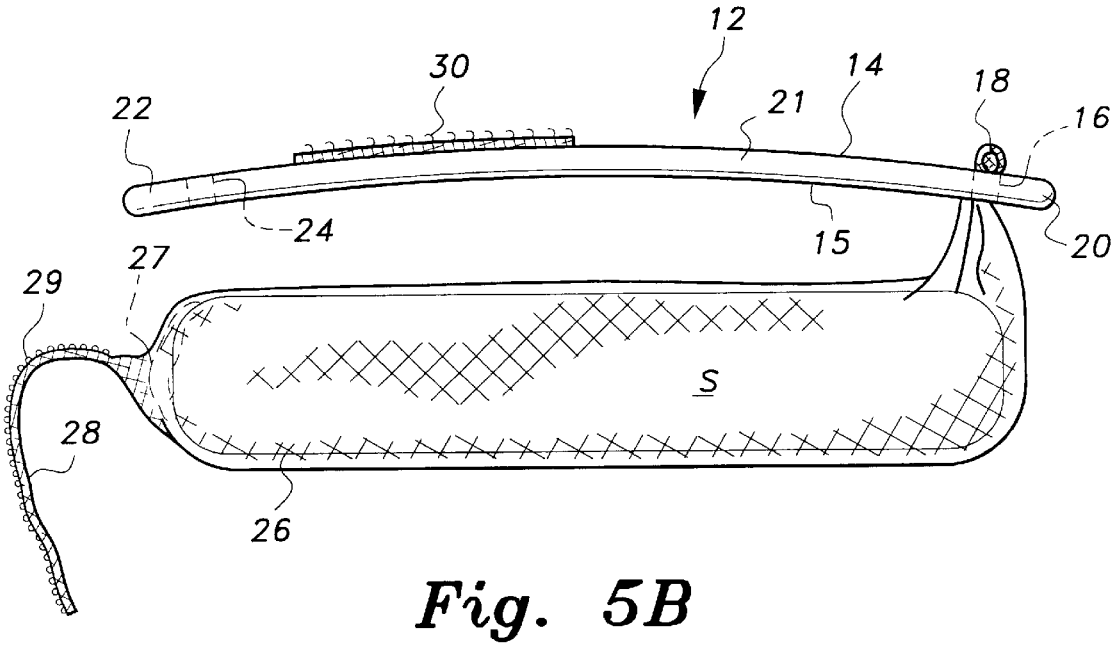
FIG. 5B is a side view similar to that of FIG. 5A in an open state.

Referring to FIG. 5A and 5B, there is shown a side view of the inventive soap holder in a closed state and an open state, respectively. As is illustrated, tubular mesh netting 26 extends downward from wide slot 16 where it envelops soap bar S. Closure strap 28 is inserted through narrow slot 24 and removably secured to hook material patch 30 by means of loop material 29 on the inner side of closure strap 28. Bunched mesh netting end 18 prevents mesh netting 26 from pulling through slot 16. The bunched netting end 18 may be made by folding over or rolling the mesh netting and applying adhesive or subjecting the bunched netting to heat sealing. As is seen in FIG. 5B netting opening 27 allows the insertion of soap bar S when closure strap 28 is freed from hook material patch 30 and removed from narrow slot 24.

Figure 6:
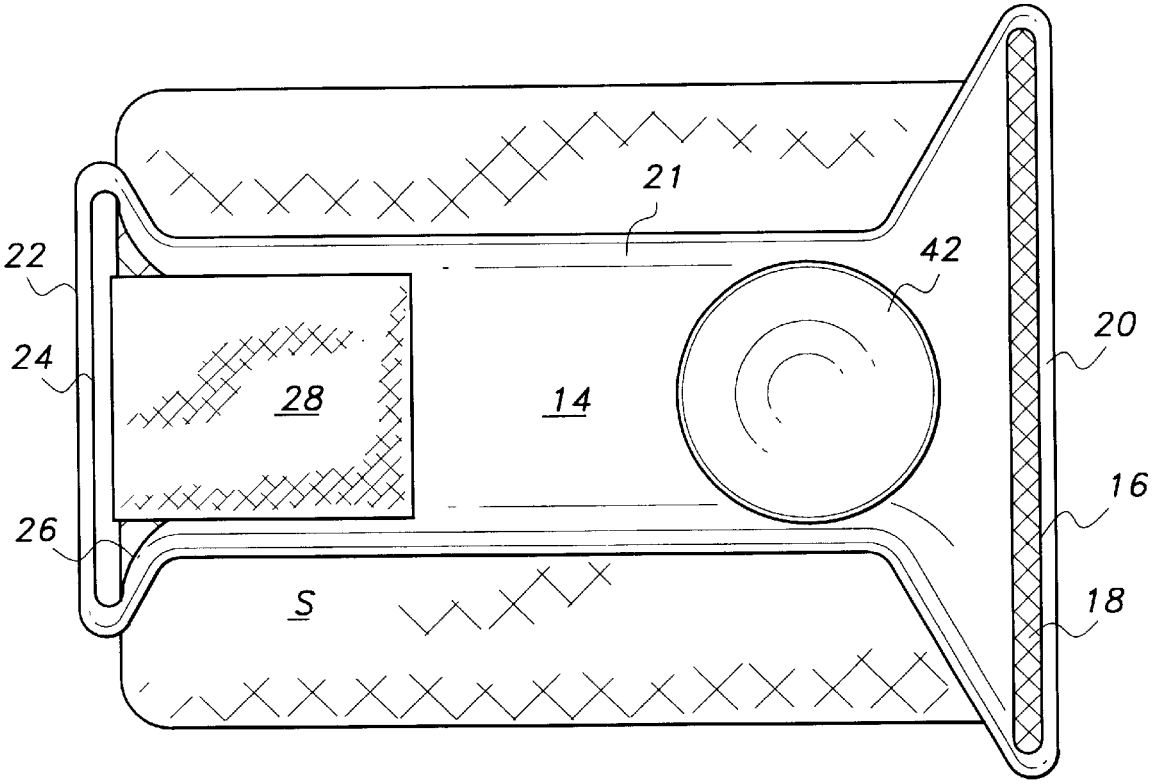
FIG. 6 is a top view similar to that of FIG. 4, showing the another embodiment of the invention having a suction cup installed on the handle.
Figure 7:
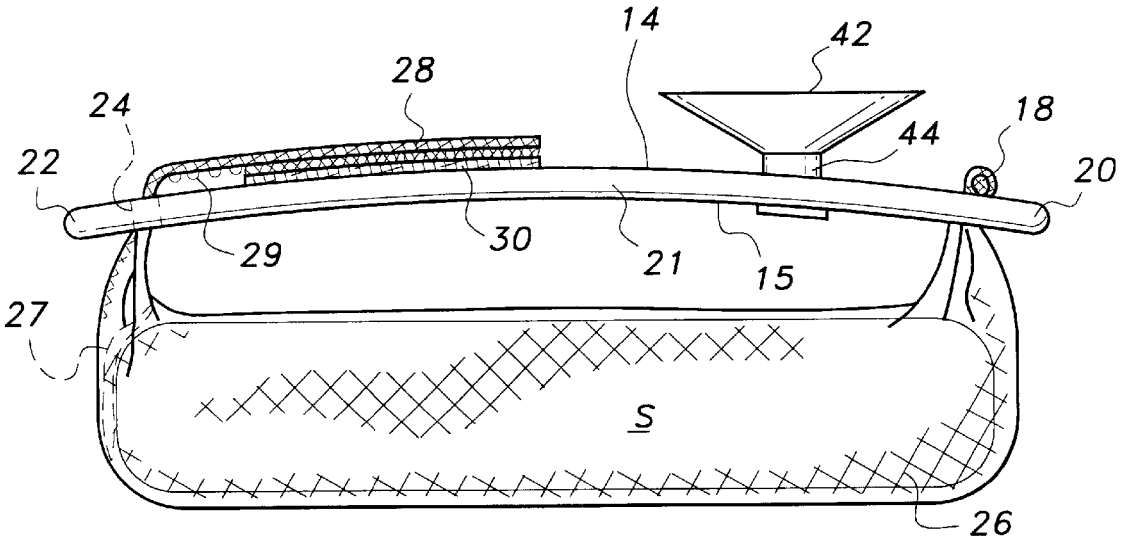
FIG. 7 is a side view of the embodiment of FIG. 6, showing the mesh netting installed and holding a soap bar, and having a suction cup installed on the handle.

Referring to FIGS. 6 and 7, there is shown a top view and a side view, respectively, of another embodiment of the inventive soap holder. This embodiment 40 is identical to that of FIGS. 1–5 with the addition a suction cup 42 mounted to the handle top side 14 by means of suction cup stem 44. Suction cup 42 is directed upwards, away from the contained soap bar S in mesh netting 26 and is preferably mounted at the end of the handle strip portion 21 nearest the wide end portion 20. The suction cup stem 44 may be attached to the handle by any desired means such as forcing its lower portion through an aperture in handle 12. The stem 44 may have a groove(not shown) which secures the stem 44 at the appropriate position within the aperture, forming a force fit. The suction cup allows the user to mount the wet soap holder containing the soap bar S on a bath wall for quick drying in the ambient air and easy accessability for the next use.

In operation, a bar of soap S is inserted into the open end of mesh netting 26 through open end 27. Mesh netting 26 holding soap bar S is folded under handle 12, and closure strap 28 inserted through narrow slot 24 of narrow end portion 22 and then pulled snug such that soap bar S is firmly held within the mesh netting 26. The loop material 29 of closure strap 28 is then secured against hook material patch 30. The soap holder 10 is then ready for a user to insert their fingers between the handle 12 and the secured soap bar S such that the soap bar and mesh netting is grasped in the palm of the user's hand H. The user then holds the soap and holder in water until wet and then proceeds to lather and scrub the skin in the bathing process. Once finished, the holder and soap remaining may easily dry in ambient air due to the highly porous nature of the mesh netting.

As the soap bar S is repeatedly used, it diminishes in size. The inventive soap holder 10 may be easily adjusted to securely hold the soap bar by freeing the closure strap 28 from the hook material patch 30, pulling the closure strap 28 snug, thus, tightening the grip of the tubular mesh netting 26 on the smaller soap bar, and securing the loop material 29 of the closure strap 28 to a new location on loop material patch 30 inboard of the previous location. The mesh netting 26 may be tightened to any desired extent to accommodate the soap bar alone or a collection of smaller soap bars or pieces of soap. The mesh netting 26 may be removed from the handle 12 and replaced by releasing the folded end portion and pulling on bunched mesh netting 18 until the entire tubular mesh netting 26 and closure strap 28 is pulled through wide slot 16.

The device is preferably worn with the narrow end 22 of handle 12 within the space between the thumb and first finger, and they wide end along the fifth finger and reaching downward along the outer edge of the hand toward the wrist. This allows the closure strap 28 to fit through the limited length between thumb and finger while maximizing the exposure of the mesh netting for use in scrubbing and minimizing twisting and turning of the device handle through wide exposure along the side of the hand.

After use, the inventive soap holder may be hung in the air for drying such as by means of mounting the soap holder to the bath wall with suction cup 42.

The mesh netting may be made of fabric or similar material. The handle 12 and suction cup 42 are preferably made of a suitable plastic material.

It is to be understood that the present invention is not limited to the embodiments described above, but encompasses any and all embodiments within the scope of the following claims.

I claim:

1. A mesh netting soap bar holder comprising:

a generally planar elongate flexible handle having a top side and a bottom side;

said handle having a wide end portion, a narrow end portion, and a strip portion extending therebetween;

a tubular mesh netting having an open end portion, a soap bar holding portion, and a closed end portion;

a closure strap attached to said open end portion of said tubular mesh netting and extending axially therefrom; and means for adjustably and removably mounting said closure strap to said handle top side;

said wide end portion of said handle defining a wide slot extending transverse of said elongate handle;

said narrow end portion of said handle defining a narrow slot extending transverse of said elongate handle;

said closed end of said tubular mesh netting being mounted in said wide slot;

said closure strap being adapted for threading through said narrow slot;

whereby a bar of soap is placed within said tubular mesh netting through said open end portion, said closure strap is threaded through said narrow slot, said is drawn snug, and said closure strap is mounted on said top side of said handle; and whereby said soap bar is confined and tightly held in a position such that when a user inserts his hand between said handle and said confined soap bar with the back of his hand against said handle bottom side, he may easily grasp said soap bar between his palm and fingers.

2. The soap bar holder of claim 1, wherein said closed end of said tubular mesh netting is bunched so as to resist pulling through said wide slot, said tubular mesh netting being inserted downward through said wide slot until said bunched closed end resists further travel therethrough.

3. The soap bar holder of claim 1, said closure strap having loop material on an inner side thereof.

4. The soap bar holder of claim 3, wherein said handle has a hook material patch mounted thereon and extending from said narrow end portion along said strip portion, said closure strap and said patch comprising said means for adjustably and removably mounting said open end portion to said handle top side.

5. The soap bar holder of claim 4, wherein said patch of hook material is so sized as to allow said loop material of said closure strap to be removably mounted at a plurality of positions along said handle top side, whereby, upon said soap bar diminishing in size with repeated use, said closure strap is adjusted along said loop material patch away from said handle narrow end portion, thus placing tension on said tubular mesh netting and thereby maintaining said soap bar in a stable position for ready grasping by the user.

6. The soap holder of claim 1, wherein said handle is configured in the general form of a "T" with said narrow end portion and said strip portion forming the tail portion of the "T" and said wide end portion forming the cross member of the "T."

7. The soap holder of claim 1, further comprising means for removably mounting said soap holder to a bath wall.

8. The soap holder of claim 7, wherein said means for removably mounting said soap holder to a bath wall is a suction cup mounted on the top side of said handle and extending upward therefrom and away from said soap bar.

9. The soap holder of claim 8, wherein said suction cup has a stem for mounting, said stem being mounted at the intersection of said strip portion and said wide end portion of said handle.

* * * * *